US007031914B2

(12) United States Patent
Case

(10) Patent No.: US 7,031,914 B2
(45) Date of Patent: Apr. 18, 2006

(54) SYSTEMS AND METHODS FOR CONCATENATING ELECTRONICALLY ENCODED VOICE

(75) Inventor: Eliot M. Case, Denver, CO (US)

(73) Assignee: Qwest Communications International Inc., Denver, CO (US)

( * ) Notice: Subject to any disclaimer, the term of this patent is extended or adjusted under 35 U.S.C. 154(b) by 733 days.

(21) Appl. No.: 10/120,476

(22) Filed: Apr. 10, 2002

(65) Prior Publication Data

US 2003/0195747 A1 Oct. 16, 2003

(51) Int. Cl.
*G10L 19/12* (2006.01)

(52) U.S. Cl. ..... 704/223; 704/219; 704/221

(58) Field of Classification Search ..... 704/219, 704/207, 209, 221, 223; 705/17
See application file for complete search history.

(56) References Cited

U.S. PATENT DOCUMENTS 5,305,421 A * 4/1994 Li ..... 704/219

5,729,694 A * 3/1998 Holzrichter et al. ..... 705/17

* cited by examiner

*Primary Examiner*—Susan McFadden
*Assistant Examiner*—Huyen X Vo
(74) *Attorney, Agent, or Firm*—Townsend and Townsend and Crew LLP

(57) ABSTRACT

A method for concatenating a series of electronic voice segments encoded according to a source modeled algorithm is provided. The source modeled algorithm includes an excitation function such as a pitch function. The method includes evaluating an excitation function of the segments to be concatenated. The method further includes combining the segments into a sequence. The method further includes altering the excitation function such that the decoded sequence more accurately represents human speech. The alteration may include adjusting the pitch excitation function across one or more concatenation points. The alteration may also include adjusting the pitch excitation function across the sequence to more accurately reflect the content of the sequence. The source modeled algorithm may be a linear predictive algorithm such as Code Excited Linear Prediction (CELP) or Linear Predictive Coding (LCP). A system for concatenating a series of electronic voice segments is also provided.

2 Claims, 2 Drawing Sheets

SYSTEMS AND METHODS FOR CONCATENATING ELECTRONICALLY ENCODED VOICE

CROSS REFERENCE TO RELATED APPLICATIONS

This application is related to copending, commonly assigned U.S. patent application Ser. No. 09/597,873, entitled "CONCATENATION OF ENCODED AUDIO FILES", filed on Jun. 20, 2000, by Eliot Case, which is a continuation of U.S. patent application Ser. No. 08/769,731, entitled "Concatenation of Encoded Audio Files", filed on Dec. 20, 1996, which applications are included herein by reference in their entirety for all purposes.

BACKGROUND OF THE INVENTION

The present invention relates generally to digitized speech and more specifically to systems, methods and arrangements for manipulating source modeled concatenated digitized speech to create a more accurate representation of natural speech.

Through the use of computers, innumerable manual processes are being automated. Even processes involving responses in the form of a human voice can be accomplished with a computer. However, when such processes involve the concatenation of multiple, digitized human voice segments, the results can sound unnatural and therefore be less acceptable.

In order to provide more acceptable human voice response systems, methods and systems are needed that more accurately replicated human voice. Further, such systems are needed that operate within present human voice response environments.

BRIEF SUMMARY OF THE INVENTION

In one embodiment, the invention provides a method of concatenating a plurality of electronic voice data segments. The plurality of segments are encoded according to a source modeled algorithm that includes at least one excitation function. Each data segment includes information relating to one of the excitation functions. The method includes evaluating the plurality of electronic voice data segments and assembling the data segments into a sequence, thereby forming at least one concatenation point. The method also includes altering an excitation function for one of the data segments based in part on the evaluation.

The segments may be encoded according to a linear predictive source modeled algorithm such as Code Excited Linear Prediction or Linear Predictive Coding. The excitation function may relate to pitch data.

In another embodiment of a method of the present invention, an excitation function for one of the data segments is altered at a concatenation point. In yet another embodiment, a method includes developing a content-based prediction of the language represented by the sequence.

The data sequence may represent a question and one of the excitation functions is related to pitch data, and the method may include adjusting the pitch excitation data, thereby causing the data sequence to more accurately represent a voiced question.

In another embodiment, the present invention provides a voice data sequence having a plurality of electronic voice data segments. Each data segment is encoded according to a source modeled algorithm and the plurality of data segments are joined into a consecutive sequence. The sequence includes at least one concatenation point at which two of the plurality of electronic voice data segments are joined. The sequence also includes at least one excitation function associated with the source modeled algorithm. One of the excitation functions is configured in part based on the content of the sequence.

In another embodiment, a system for producing a sequence of concatenated electronic voice data segments includes an arrangement that selects a plurality of electronic voice data segments from a collection of electronic voice data segments. The plurality of selected segments are encoded according to a source modeled algorithm. The system also includes a processor configured to evaluate the plurality of electronic voice data segments. The algorithm includes at least one excitation function and each of the plurality of data segments includes information relating to the excitation function. The processor is further configured to alter the excitation function for at least one of the plurality of data segments based in part on the evaluation. The processor is further configured to assemble the plurality of data segments into a sequence and cause the sequence to be transmitted to an external electronic device.

Reference to the remaining portions of the specification, including the drawings and claims, will realize other features and advantages of the present invention. Further features and advantages of the present invention, as well as the structure and operation of various embodiments of the present invention, are described in detail below with respect to the accompanying drawings.

BRIEF DESCRIPTION OF THE DRAWINGS

A further understanding of the nature and advantages of the present invention may be realized by reference to the remaining portions of the specification and the drawings wherein like reference numerals are used throughout the several drawings to refer to similar components.

DETAILED DESCRIPTION OF THE INVENTION

Figure 1:
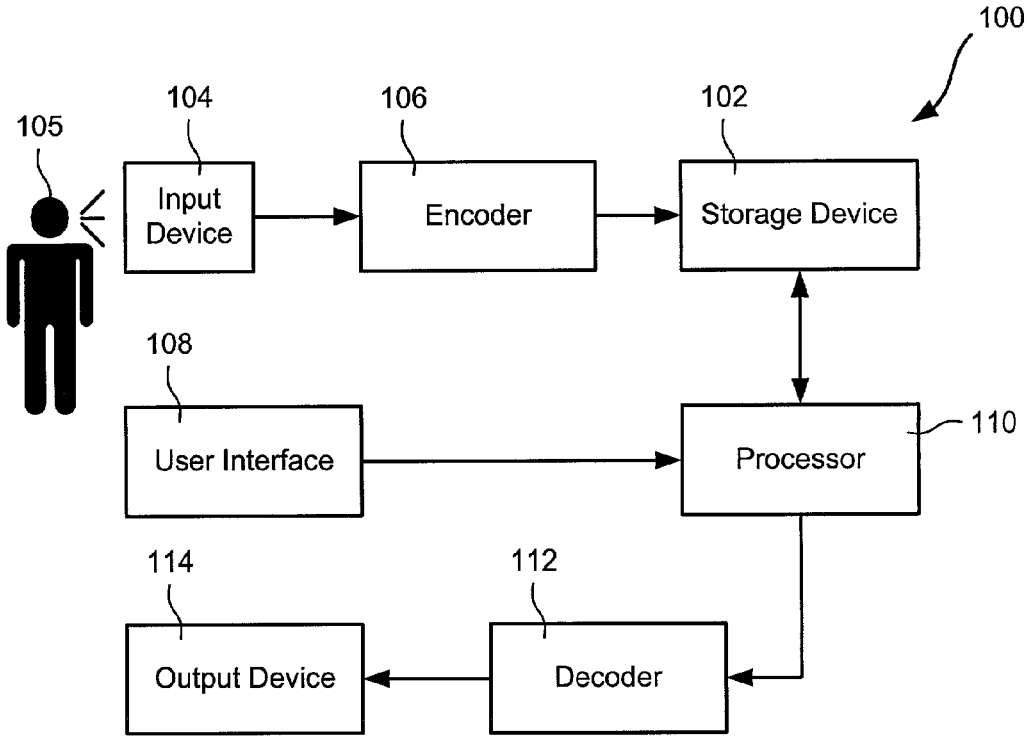
FIG. 1 illustrates a first embodiment of a system for concatenating electronic voice segments according to the present invention.

An invention is disclosed herein for producing more accurate representations of voices, sounds and/or recordings in digitized voice systems. This description is not intended to limit the scope or applicability of the invention. Rather, this description will provide those skilled in the art with an enabling description for implementing one or more embodiments of the invention. Various changes may be made in the function and arrangement of elements described herein without departing from the spirit and scope of the invention as set forth in the appended claims.

The present invention relates to digitized speech. Herein, the phrases "digitized speech", "electronic voice" and "electronically encoded voice" will be used to refer to digital representations of human voice recordings, as distinguished from synthesized voice, which is machine generated. "Concatenated voice" refers to an assembly of two or more electronic voice segments, each typically comprising at least one syllable of English language sound. However, the present invention is equally applicable to concatenations of voice segments down to the phoneme level of any language.

Voice response systems allow users to interact with computers and receive information and instructions in the form of a human voice. Such systems result in greater acceptance by users since the interface is familiar. However, voice response systems have not progressed to the point that users are unable to distinguish a computer response from a human response. Several factors contribute to this situation.

Automated response systems often have many potential responses to user selections. Thus, automated voice response systems often include many potential voiced responses, some of which may include many words or sentences. Because it is rarely practical to store a separate voice segment for each unique response, voiced responses typically include a sequence of concatenated segments, each of which may be a phrase, a word, or even a specific vocal sound. However, unlike human speech, concatenated electronic voice does not necessarily produce realistic transitions between segments (i.e., at concatenation points).

Further, in human speech, the sound of a particular verbal segment may be context dependent. Sounds, words or phrases may sound different, for example, in a question verses an exclamation. This is because human speech is produced in context, which is not necessarily the case with concatenated voice. However, the present invention provides content-based concatenated voice.

Voice response systems may employ compression or encoding algorithms to reduce transmission bandwidth or data storage space. Such encoding methods include source modeled algorithms such as Code Excited Linear Prediction (CELP) and Linear Predictive Coding (LPC). CELP is more fully explained in Federal Standard 1016, Telecommunications: Analog to Digital Conversion of Radio Voice by 4,800 Bit/Second Code Excited Linear Prediction (CELP), dated Feb. 14, 1991, published by the General Services Administration Office of Information Resources Management, which publication is incorporated herein by reference in its entirety. LPC is more fully explained in Federal Standard 1015, Analog to Digital Conversion of Voice by 2,400 Bit/Second Linear Predictive Coding, dated Nov. 28, 1984, published by the General Services Administration Office of Information Resources Management, which publication is incorporated herein by reference in its entirety. Further information regarding the use of one type of LPC encoding is provided in the article, Voiced/Unvoiced Classification of Speech with Application to the U.S. Government LPC-10E Algorithm, published in the proceedings of the IEEE International Conference on Acoustics, Speech and Signal Processing, 1986, which publication is incorporated herein by reference in its entirety. Methods and systems for concatenating such encoded audio files are more fully explained in previously incorporated U.S. patent application Ser. No. 09/597,873.

Voice encoding systems, such as CELP, reduce transmission bandwidth by modeling the vocal source by representing the speech as a combination of excitation functions and reflection coefficients representing different voice characteristics. The present invention manipulates the excitation functions of concatenated segments to produce a more realistic representation of speech.

As an example, consider a telephone directory assistance system accessed through the use of a cellular telephone. Some cellular telephone systems may use source-modeled algorithms to encode transmissions, thereby reducing transmission bandwidth. In such cellular telephone systems, the phone itself may be both an encoder and decoder of source-modeled voice signals.

In this example, the directory assistance system includes a library of sounds, words, phrases and/or sentences of encoded vocal segments that are selectively combined according to the present invention to produce responses to directory assistance inquires from cellular phone users. Because the library sounds may have a different content characteristic than what is appropriate for a particular system response, the present invention content-adjusts the characteristic prior to transmitting the response to the user. For example, a sequence of library segments may individually have different pitch characteristics, some of which may not be appropriate for the sequence as a whole. Further, one segment may end at a different pitch than the pitch at which the next segment begins. The present invention corrects these anomalies, resulting in a more natural sounding response. The present invention is further advantageous in that content-adjusted segments are readily decodable by ubiquitous cellular telephone devices. The present invention is explained in greater detail in the following description and figures.

FIG. 1 illustrates an embodiment of a voice response system 100 for producing concatenated speech according to one example of the present invention. The voice response system 100 may be, for example, a telephone directory assistance system as explained previously. Other systems might include voice response banking systems, credit card information systems, and the like. A user might initiate contact with the system through a cellular telephone or other communications device and provide the system with information that would enable the system to provide the user with a requested address or phone number. In order to perform this function, the system 100 might include a library of encoded sounds, words and/or phrases that would be combined to constitute the response from the system. Thus, the system 100 includes an electronic storage device 102 that includes the library of sounds. The storage device 102 might be, for example, a magnetic disk storage device such as a disk drive. Alternatively, the storage device 102 might be an optical storage device such as a compact disk or DVD. Other suitable storage systems are possible and are apparent to those skilled in the art.

The library of sounds stored on the storage device 102 may include complete sentences, phrases, individual words, or even the discrete sounds that make up human speech. The library of sounds might be created, for example, by recording the sounds from one or more people. For example, an input device 104, such as a microphone, receives sounds generated by a human 105 and converts the sounds to analog signals. The analog signals are then processed by an encoder 106 to produce source model encoded segments. The segments are then stored on the storage device 102 for later use.

Continuing to refer to FIG. 1, a user initiates contact with the system 100 through a user interface 108. The user interface might be, for example, a cellular phone, a standard telephone, an Internet connection, or any other suitable communication device. The system 100 might respond to voice commands, in which case the user would initiate a request by speaking into a microphone associated with the interface 108. Alternatively, the system 100 might respond to commands entered by way of a telephone or cellular phone keypad or other entry device, such as a computer keyboard. The commands from the user are received by a processor 110, which controls the response the system 100 provides to the user.

In generating the response, the processor assembles from the storage device 102 a collection of sound segments representing a voiced response. For example, in the case of a telephone directory system, the processor might assemble a collection of sounds that represent a phone number. Once assembled, the processor 110 sends the response to a decoder 112 that decodes the response from a source modeled signal into an electronic sound signal. An output device 114, such as a speaker, converts the decoded electronic signal into sound that the user interprets as speech.

The decoder 112 and output device 114 may be co-located with the user interface, as would be the case, for example, with a cellular phone. Because source modeled systems require less bandwidth for the same amount of information as digitally sampled sound of the same quality, many cellular phones include a source modeled decoder. Alternatively, the decoder 112 could be located apart from the output device 114.

According to some embodiments of the present invention, the processor 110 also performs signal processing on voice responses. As is well known, some source modeled audio encoding algorithms, LPC in particular, include an excitation function that represents the pitch profile of the encoded speech. The pitch excitation function is useful, for example, in representing vocal inflections in a speech segment. However, a sound segment selected from a library of sound segments stored on the storage device 102 might not have an appropriate pitch profile for a particular response. For example, the sound segment might be included in a sequence of sound segments that together represent a question, yet have a pitch profile more appropriate for a statement. Further, the pitch profile of one segment might end at a level different from the beginning level of the next sound segment in the sequence, in which case the decoded segment may result in unnatural pitch variations. Therefore, the processor 110 evaluates the sound segments included in the sequence and makes certain alterations.

Figure 2:
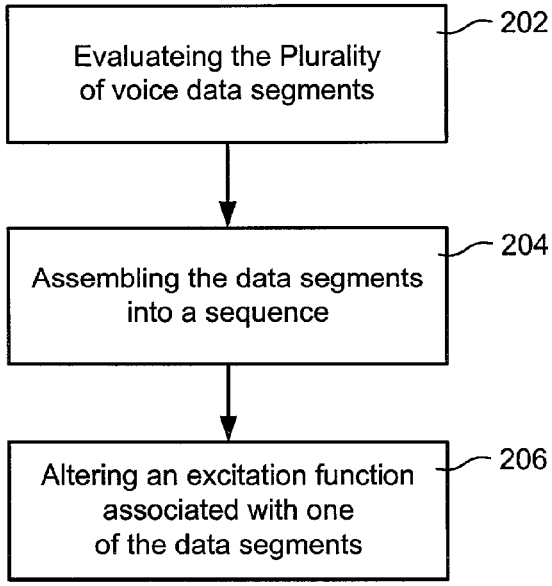
FIG. 2 illustrates one embodiment of a method of concatenating electronic voice segments according to the present invention that may be implemented on the system of FIG. 1.

The process by which the processor 110 alters the pitch excitation function may be understood with reference to FIG. 2. FIG. 2 illustrates a method 200 of altering concatenated encoded vocal sound segments. At operation 202, the processor extracts the desired excitation function data from the encoded segments, in this example, the pitch excitation data. The processor then evaluates the pitch excitation function of each sound segment. This operation may take place either before or after the processor assembles the segments into a sequence, illustrated as operation 204. The evaluation at operation 202 accomplishes two functions. First, the evaluation determines the relative level of the pitch for adjacent segments at the concatenation points. Second, the evaluation determines the content of the sequence in terms of the words represented by the segments and compares the profile of the pitch excitation function for the sequence to the content. For example, if the sequence begins with a segment or segments representing a word that indicates the sequence is a question, the processor determines if the pitch profile of the concatenated sequence represents the proper voice inflection of a question.

At operation 204, the processor assembles the sound segments into a sequence. At operation 206, the processor alters the profile of the pitch excitation function based on the evaluation at step 202. The alteration may account for either or both aspects of the evaluation. First, the processor may alter the pitch excitation function values around concatenation points such that the decoded sequence would more accurately represent human speech. Second, the processor may alter the profile of the pitch excitation function across the sequence to more accurately represent the context of the speech. The actual alterations made by the processor during the method 200 may be understood better with reference to a specific example illustrated in FIGS. 3*a–d*.

Figure 3A:
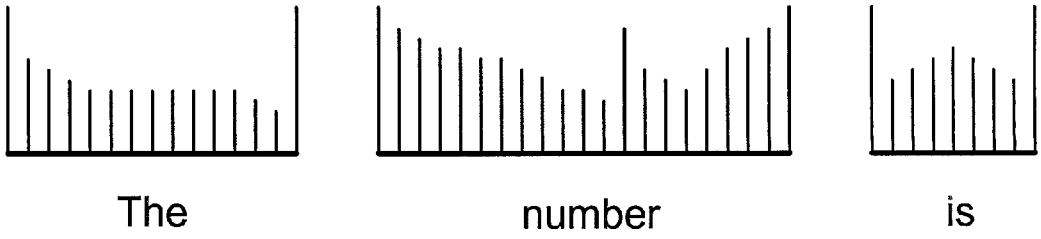
FIG. 3*a* illustrates the profile of the pitch excitation function for three sound segments to be combined into a sequence according to the method of FIG. 2.

FIG. 3*a* illustrates the pitch profile for three words to be concatenated to form a sequence. Although this illustration includes a sequence of words, it should be noted that the sequence could include sounds or phrases. The profile for each word includes a number of bars in a graph representing the pitch at regular intervals over the duration of each segment. According to the LPC standard, the interval is 22.5 msec. According to the CELP standard, the interval may be either 7.5 msec at the sub-frame level, or 30 msec at the frame level. The present invention is applicable to either. For ease of illustration, the interval in this example is not based on a regular sampling interval, but is shown as a relative approximation of the pitch profile.

Figure 3B:
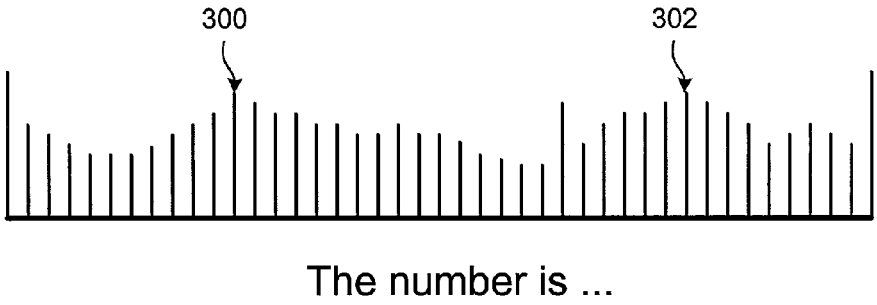
FIG. 3*b* illustrates the profile of the pitch excitation function for the sequence created by concatenating the three sound segments of FIG. 3*a* according to the method of FIG. 2.

The three words illustrated in FIG. 3*a* are being combined to form the phrase, "the number is . . . ", which might precede a requested telephone number in an automated telephone directory assistance system. The altered pitch profile is illustrated in FIG. 3*b*. As is evident from FIG. 3*a*, the pitch at the end of the word "the" is much lower than the pitch at the beginning of the word "number". However, in the altered pitch profile illustration of FIG. 3*b*, the pitch at the concatenation point between "the" and "number", represented by reference numeral 300, has been "smoothed" by increasing the pitch slightly over several intervals before the concatenation point and by decreasing the pitch for a few intervals after the concatenation point. In this example, the processor determines similar alterations to be made at a concatenation point 302 between the words "number" and "is".

The specific alterations may be made using any of a number of techniques. For example, the processor may determine an average pitch level over a number of intervals before and after the concatenation point and determine a "best fit" slope over the period. Other possibilities exist and are apparent to those skilled in the art in light of this description.

Figure 3C:
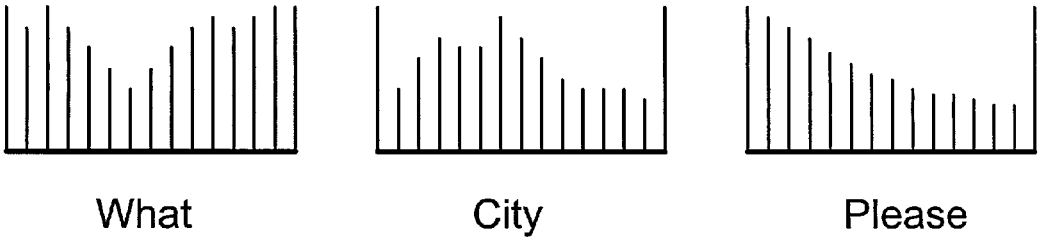
FIG. 3*c* illustrates the profile of the pitch excitation function for three additional sound segments to be combined into a sequence according to the method of FIG. 2.
Figure 3D:
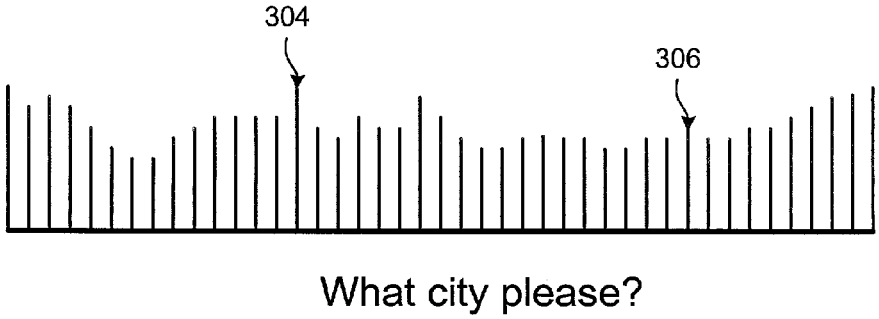
FIG. 3*d* illustrates the profile of the pitch excitation function for the sequence created by concatenating the three sound segments of FIG. 3*c* according to the method of FIG. 2.

FIG. 3*c* illustrates the pitch profile associated with a second series of words to be combined into a sequence. In this example the three words "what", "city" and "please" are being combined to form the question "what city please?", which might be used in a voice response telephone directory assistance system to prompt a user to speak or enter the name of a city from which a telephone number is desired. In this example, in addition to altering the pitch level before and after each of concatenation points 304 and 306 of FIG. 3*d*, the processor also alters the pitch level over the sequence to more accurately reflect the vocalized question.

Determining the content of the speech represented by the sound segments could be accomplished in any of a number of ways. For example, the processor could make some prediction of the content based on the context of the response. Because the processor is determining what sound segments to select from the library, the processor's programming could include software that allows the processor to determine the content of the concatenated sequence. Other possibilities exist and are apparent to those skilled in the art in light of this disclosure.

Although only a few examples of the present invention are illustrated herein, many more are apparent to those skilled in the art in light of this disclosure. For example, the present invention is not limited to altering the pitch profile of encoded sequences that represent English language. Systems could be designed for other languages, each having vocal styles particular to the language. Further, the present invention is not limited to altering the profile of the pitch excitation function. Other excitation functions and reflection coefficients could be altered and other source modeled encoding algorithms could be used without departing from the spirit and scope of the present invention as defined by the following claims.

What is claimed is:

1. A method of concatenating a plurality of electronic voice data segments, the plurality of segments being encoded according to a source modeled algorithm, the algorithm including at least one excitation function, wherein each data segment includes information relating to an excitation function and wherein at least one excitation function is usable within a Code Excited Linear Prediction system to synthesize voice, the method comprising:

evaluating the plurality of electronic voice data segments;

assembling the data segments into a sequence, thereby forming at least one concatenation point;

developing a content-based prediction of the language represented by the sequence;

extracting said at least one excitation function from the sequence; and modifying the excitation function at the concatenation point for at least one of the data segments based in part of the evaluation and the prediction to thereby produce a voice inflection representative of the language represented by the sequence;

wherein the sequence represents a question and one of the excitation functions is related to pitch data, the method, further comprising adjusting the pitch excitation data, thereby causing the data sequence to more accurately represent a voiced question.

2. A system for producing a sequence of concatenated electronic voice data segments, comprising:

an arrangement that selects a plurality of electronic voice data segments from a collection of electronic voice data segments, the plurality of selected segments being encoded according to a source modeled algorithm; and a processor, configured to:

evaluate the plurality of electronic voice data segments, wherein the algorithm includes at least one excitation function usable within a Code Excited Linear Predictive system to synthesize voice and each of the data segments includes information relating to the excitation function;

assemble the data segments into a sequence, thereby forming at least one concatenation point;

develop a content-based prediction of the language represented by the sequence;

extract an excitation function from the sequence;

modify the excitation function for at least one of the plurality of data segments based in part on the evaluation and the content of the prediction to thereby produce a voice inflection representative of the language represented by the sequence; and cause the sequence to be transmitted to an external electronic device.

* * * * *